US005588639A

United States Patent [19]

Holman

[11] Patent Number: 5,588,639

[45] Date of Patent: Dec. 31, 1996

[54] ONE MAN LIFT FOR MOTORCYCLES

[76] Inventor: John A. Holman, 10424 S. Church St., Chicago, Ill. 60643

[21] Appl. No.: 417,819

[22] Filed: Apr. 6, 1995

[51] Int. Cl.[6] ..... B66F 3/00

[52] U.S. Cl. ..... 254/133 R; 254/DIG. 4; 254/8 B

[58] Field of Search ..... 254/131, 133, 254/134, DIG. 4, 3 R, 3 B, 3 C, 94, 100, 101

[56] References Cited

U.S. PATENT DOCUMENTS 2,135,765 11/1938 Paine ..... 254/DIG. 4

4,925,160 5/1990 Auvoja ..... 254/101

5,294,098 3/1994 Bundy ..... 254/8 B

*Primary Examiner*—Robert C. Watson

*Attorney, Agent, or Firm*—Emrich & Dithmar

[57] ABSTRACT

A support structure for lifting a motorcycle in combination with a jack with the support structure including a cradle adapted to fit over an elevatable portion of the jack. The cradle has a pair of longitudinally extending support members connected thereto and shiftably fits on an elevatable portion of the jack to permit tilting of the support members supporting the motorcycle providing access to either the front or rear wheel of the motorcycle.

8 Claims, 1 Drawing Sheet

ONE MAN LIFT FOR MOTORCYCLES

BACKGROUND OF THE INVENTION

This invention relates to a motorcycle jack and more particular to a motorcycle jack assembly useful to permit a single person to position the motorcycle in a variety of orientations in order to allow work to be done on the motorcycle. The device of the present invention is small, portable and easily handled by a single person.

In many repairs of a motorcycle, it is desirable, if not necessary, to position at least a part of the motorcycle off the ground so that the repair person can more easily repair the motorcycle. Two major problems have been encountered in past attempts to design and construct a motorcycle jack assembly to support at least part of the motorcycle in a raised position. The first problem has been the difficulty, after the motorcycle has been jacked up, to prevent the motorcycle wheels from moving during the repair operation. The second major problem has been slippage of the jack assembly during the repair operation.

Another disadvantage with prior jack assemblies which have been proposed is that they are cumbersome, often very heavy and are not easily portable. Sometimes, in fact, they even require the use of two people to operate same. Examples of various jack assemblies proposed for motorcycle bikes are illustrated in U.S. Pat. Nos. 4,681,299 issued to Siebert Jul. 21, 1987, 5,193,784 issued to Obernberger Mar. 16, 1993 and 5,211,376 issued to Anderson May 18, 1993.

All of these inventions may be operable for their intended purposes, but none provides the versatility and portability of the present invention which enables a single person to operate the jack assembly herein described and also enables the jack assembly to be moved by a single person on a motorcycle to any preferred location or among various locations.

SUMMARY OF THE INVENTION

Therefore, it is an object of this invention to provide a motorcycle jack assembly that can support a motorcycle in a variety of angularly orientations wherein at least a part of the motorcycle is elevated.

Another object of the invention is to provide a motorcycle jack assembly that can prevent one of the motorcycle wheels from moving after the motorcycle has been positioned in a raised position.

Still another object of the invention is to provide a motorcycle jack assembly that prevents slippage of the jack used to raise the motorcycle.

Another object of the invention is to provide a jack assembly for a motorcycle which is light weight, portable and easily handled by a single person.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
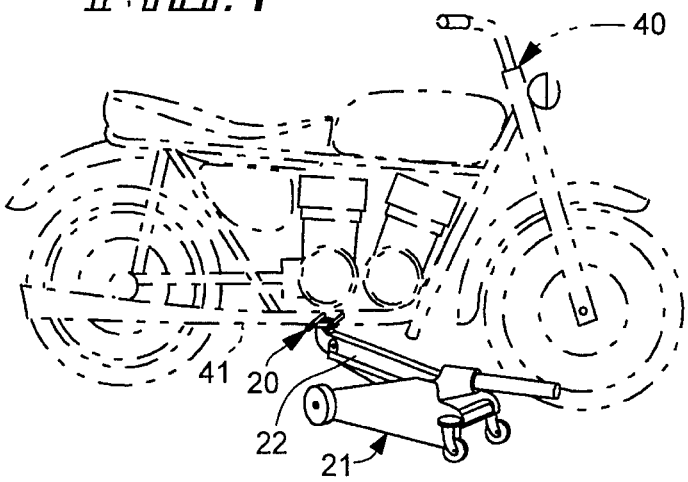
FIG. 1 is a view showing a motorcycle in phantom line in combination with a standard hydraulic jack and the assembly of the present invention illustrating the location of the motorcycle jack and hydraulic lifting mechanism positioned to lift a motorcycle into a desired working position.
Figure 2:
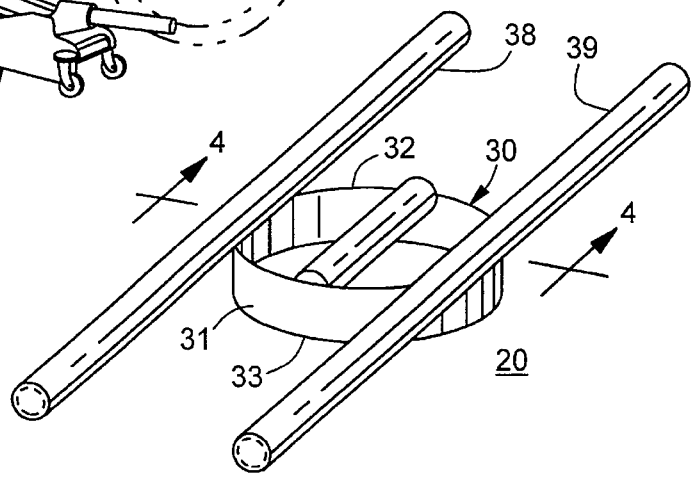
FIG. 2 is an isometric view of the motorcycle jack fixture of the present invention.
Figure 3:
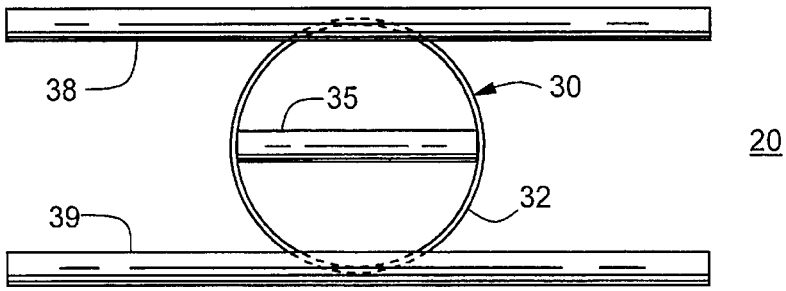
FIG. 3 is a top plan view of the fixture illustrated in FIG. 2.

Referring now to the drawings, there is disclosed a motorcycle jack fixture 20 which is used in combination with a common hydraulic floor jack 21, the hydraulic floor jack 21 having a normal lifting arm 22. At one end of the lifting arm 22 is a lifting head 25 which usually is circular in top plan view and includes a piston base 26 and a piston end cap 27. The piston end cap 27 is usually the portion of the hydraulic floor jack 21 which comes in contact with the load to be lifted such as the motorcycle 40 which is illustrated in phantom in FIG. 1.

The motorcycle jack fixture 20 includes a cradle 30. The cradle 30 is a small cylinder having a side wall 31 with a top edge 32 and a bottom edge 33. Extending across the cradle 30 and fixedly mounted thereto as by welding is a tubular member 35 positioned so that at least a portion of the tubular member 35 extends above the top edge 32 of the cradle 30. Two other axially extending tubular members 38 and 39 are fixed to the cradle 30 and more particularly, to the top edge 32 thereof such as by welding, the members 38 and 39 being parallel to the member 35 but being entirely above the top edge 32 whereas the member 35 is only partially above the top edge 32.

Figure 4:
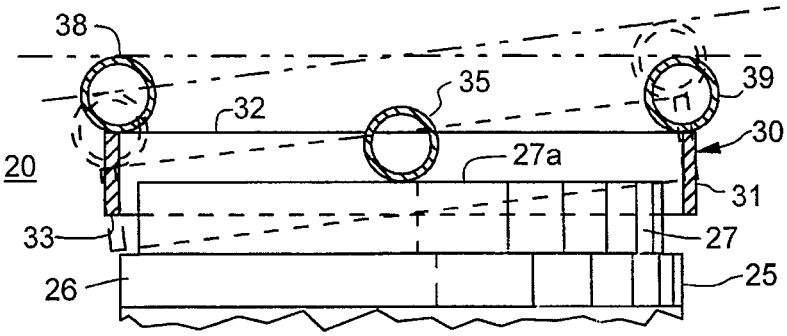
FIG. 4 is a view in section of the device illustrated in FIG. 2 taken along line 4—4 thereof.

The diameter of the cradle 30 is somewhat larger than the piston end cap 27, as seen in FIG. 4 such that the cradle 30 fits over the end cap 27 so that the bottom of tubular member 35 engages the top surface 27*a* of the piston end cap 27 or engages the top edge of lifting head 25 in order to permit a motorcycle 40 to be supported on top of the parallel tubular members 38 and 39 with the parallel tubular members having the motorcycle exhaust pipes 41 arranged generally perpendicular to the members 38 and 39. When the cradle 30 is in the full line position as illustrated in FIG. 4, the motorcycle 40 is generally level, that is with both wheels off the ground. When it is desired for the motorcycle 40 to be tilted, then the cradle can be moved to the dotted line position in FIG. 4 in which the cylindrical member sidewall 31 is tipped so that one wheel of the motorcycle 40 is on the ground and the other is airborne. In the position illustrated in dotted line in FIG. 4, the motorcycle 40 is still stable and can be worked on by a single individual. Of course, if it is desired to tip the motorcycle 40 in the other direction, then it is a simple matter to do that also.

As can be seen, the fixture 20 can be moved from site to site and only weighs a matter of pounds. It can be transported in luggage usually associated with motorcycles and convenient to be used by a single person.

While there has been disclosed what is considered to be the preferred embodiment of the present invention, it is understood that various changes in the details may be made without departing from the spirit, or sacrificing any of the advantages of the present invention.

I claim:

1. A support structure for lifting a motorcycle in combination with a jack, said support structure comprising a cylindrical cradle adapted to fit over an elevatable portion of the jack and having a tubular member extending across said cylindrical cradle positioned above the bottom of said cylindrical cradle to provide a rocking or tilting motion of said cradle with respect to the elevatable portion, said cylindrical cradle has a pair of longitudinally extending tubular support members connected to the top of said cylindrical cradle at the periphery thereof, said cylindrical cradle having a shiftable fit with respect to said elevatable portion of the jack to permit tilting of said support members supporting the motorcycle providing access to either the front or rear wheel of the motorcycle.

2. The support structure of claim 1, wherein said cradle is a cylindrical ring.

3. The support structure of claim 1, wherein said cradle has an effective diameter greater than the elevatable portion of the jack and means for providing rocking motion of said cradle with respect to said elevatable portion.

4. The support structure of claim 1, wherein the elevatable portion is circular and said cradle is cylindrical with a diameter larger than the circular elevatable portion of the jack and a pivot on said cradle supports said cradle on the elevatable portion.

5. The support structure of claim 4, wherein said cradle is supported above the elevatable portion to permit tilting of a motorcycle supported on said support means.

6. The support structure of claim 1, wherein said support members are tubes secured to the top of said cradle.

7. The support structure of claim 1, wherein said pair of longitudinally extending support members are tubular.

8. The support structure of claim 7, wherein said tubular member extending across said cylindrical cradle is parallel to said tubular support members, said tubular support members extending beyond said cradle.

* * * * *